United States Patent [19]

Keyes

[11] 4,111,128

[45] Sep. 5, 1978

[54] SWITCH LIFTING FRAME

[75] Inventor: John Keyes, Hammond, Ind.

[73] Assignee: Canron Railgroup, West Columbia, S.C.

[21] Appl. No.: 659,849

[22] Filed: Feb. 20, 1976

[51] Int. Cl.[2] ..... E01B 27/17

[52] U.S. Cl. ..... 104/7 B; 104/12

[58] Field of Search ..... 104/7 R, 7 B, 8, 12

[56] References Cited

U.S. PATENT DOCUMENTS

| | | | |
|---|---|---|---|
| 1,784,963 | 12/1930 | Holt et al. | 104/8 |
| 2,966,123 | 12/1960 | Talboys | 104/7 R X |
| 3,299,833 | 1/1967 | Stewart | 104/7 R |
| 3,401,642 | 9/1968 | Fisher | 104/7 B X |
| 3,832,952 | 9/1974 | Hurni | 104/7 B |
| 3,968,752 | 7/1976 | Theurer | 104/7 B |

*Primary Examiner*—Randolph A. Reese

[57] ABSTRACT

A railroad track lifting an aligning frame particularly for operation in switches has a rail engaging sub frame extending transversely of the main frame of a tamping machine. The sub frame has two members connected for relative adjustment transversely of the main frame in a telescoping fashion. A rail contacting element is provided on each member and abuts the inside of the rail of the track. A jack is provided to adjust and maintain the relative position of the members transversely of the main frame of the machine so as to adjust the track gauge spacing between the rail contacting elements. A pair of substantially vertically extending rail guides, one for each rail of the track are provided as is a device for moving the guides transversely of the main frame in the sub frame. Rail hooks are provided for each guide means which rail hooks externally engage each rail of the track. A track lifting jack is provided for each rail and is connected on the one hand to the main frame of the machine and on the other hand to one of the rail hooks. A track aligning jack is operatively connected between the main frame of the machine and the sub frame.

8 Claims, 2 Drawing Figures

SWITCH LIFTING FRAME

BACKGROUND OF THE INVENTION

The present invention relates to the railroad track lifting and aligning apparatus particularly a railroad track lifting and aligning apparatus of the frame type which is suspended from a load carrying beam or chassis. The invention is especially concerned with devices of this nature which are useful for operating in complex rail situations such as switches. In the past the lifting and aligning frames which were used in switches were of complex configuration to allow for the many adjustments which had to be made to the rail clamping devices to account for the different spacings of the rails in the switches.

The present invention seeks to simplify the construction of railroad track lifting and aligning apparatus which is capable of working in switches without sacrificing the versatility of operation.

SUMMARY OF THE INVENTION

According to the present invention there is provided a railroad track lifting and aligning apparatus mounted for track travel on a longitudinally extending main frame which apparatus comprises a rail engaging sub frame extending transversely of the main frame and having two members connected for relative adjustment transversely of the main frame; a rail contacting element on each member for abutting the inside of a rail of the track; means to adjust and maintain the relative position of the members transversely of the main frame whereby to adjust the track gauge spacing between the rail contacting elements; a pair of substantially vertically extending rail hook guide means one for each rail of the track; means for moving the guide means transversely of the main frame on the sub frame; rail hook means for each guide means for externally engaging each rail of the track; a track lifting jack for each rail connected on the one hand to said main frame and on the other hand to a rail hook means and track aligning jack means operatively connected between said main frame and said sub frame.

In a preferred construction the sub frame members are connected together in telescoping relation and the rail contacting elements are provided externally one on each member. Preferably the means for adjusting and maintaining the relative position of the telescoping members is a jack means connected at each end to one of the members and extending transversely of the main frame.

According to a preferred construction of the invention the rail hook guide means for each rail are mounted on sliding guides each telescoped within a respective one of the telescoping members and the means for moving the rail hook guide means transversely of the main frame comprises a jack means for each guide means each connected on the one hand to one of the guide means and on the other hand to a common one of the telescoping members.

According to a preferred feature of the invention each rail hook means may comprise an inwardly directed hook end and an upwardly extending portion adapted to slide in the rail hook guide means and terminating in an articulated connecting means for connection to one of the track lifting jacks.

According to yet a further preferred embodiment of the invention locking means may be provided to lock the rail hook means to the rail hook guide means whereby to lock the sub frame to the track lifting jacks for lifting and lowering the sub frame and out of and into track engagement position. The track lifting jacks are, in a preferred configuration, provided with further articulated connecting means remote from the point of connection to the respective rail hook means.

BRIEF DESCRIPTION OF THE DRAWINGS

The following is a description by way of example of one embodiment of the present invention reference being had to the accompanying drawings in which.

DESCRIPTION OF PREFERRED EMBODIMENT

Figure 1:
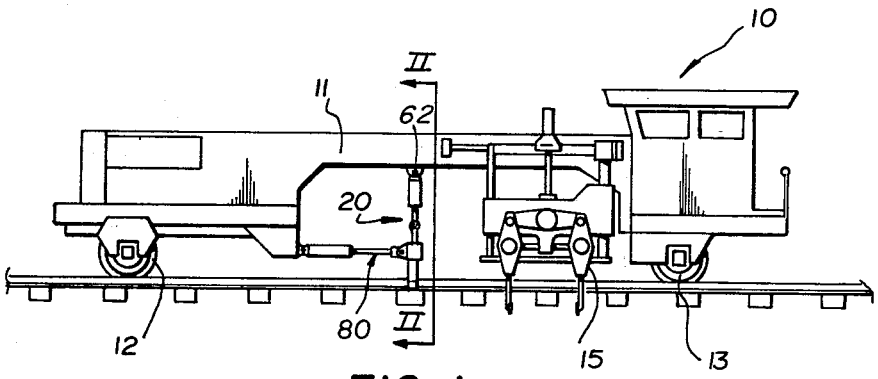
FIG. 1 is a diagramatic illustration in elevation of a tamping machine incorporating the lifting and aligning apparatus.

Referring now to the drawings, a tamping machine 10 has a longitudinally extending main frame 11 mounted on front and rear wheels 12, 13. A conventional tamping head 15 of the vibratory squeeze type is located on the frame. Suspended from the main frame 11 is a track lifting and aligning apparatus 20. The apparatus 20 comprises a track engaging sub frame 21 which has two members 23, 24, one telescoped inside the other. The member 24 has a sleeve 25 which fits therein and is attached thereto by bolts 27 at the end remote from the end into which the member 23 telescopes.

Mounted externally of the underside of the telescoping members 23, 24 are a pair of rail contacting elements 33 and 34 respectively and mounted externally at the upper edges of the members 23, 24 are connecting elements 35, 36 between which is provided a hydraulic jack 37. The relative transverse positions of the members 23, 24 relative to the longitudinally extending main frame 11, that is to say transversely of the track is determined by the jack 37 which is operated hydraulically in conventional fashion to create a telescoping movement of the member 23 into or out of the member 24 whereby to position the rail contacting elements 33, 34 so that they may be in abutting relationship with the inside of the rails R.

A pair of substantially vertically extending rail hook guide members 40 and 41 are mounted on sliding guide members 43, 44 respectively for telescoping movement within the telescoping members 23 and the sleeve 25 of the telescoping member 24, respectively. The transverse adjustment of the guide members 40 and 41 is by means of hydraulic jacks 46, 47 which are respectively connected to the sliding guides 43, 44 and extend within the sub frame 21 to be connected at 49, 48 to the inside of the member 23. Operation of the jacks 46, 47 in conventional hydraulic fashion moves the sliding guides 43, 44 within the member 23 and the sleeve 25 to move the rail hook guide means 40, 41 transversely of the track.

Within each of the rail hook guide means 40 and 41 is a rail hook means 50, 51 having a lower inwardly directed hook 53, 54 and an upwardly extending portion 56, 57 which slides within the vertical guides 40, 41 and terminates at its upper end in an articulated connection 58, 59 which are connected to similar articulated connections on the piston rods of the track lifting jacks 60 and 61, which track lifting jacks are themselves connected to the frame 11 by universal joints 62, 63.

Figure 2:
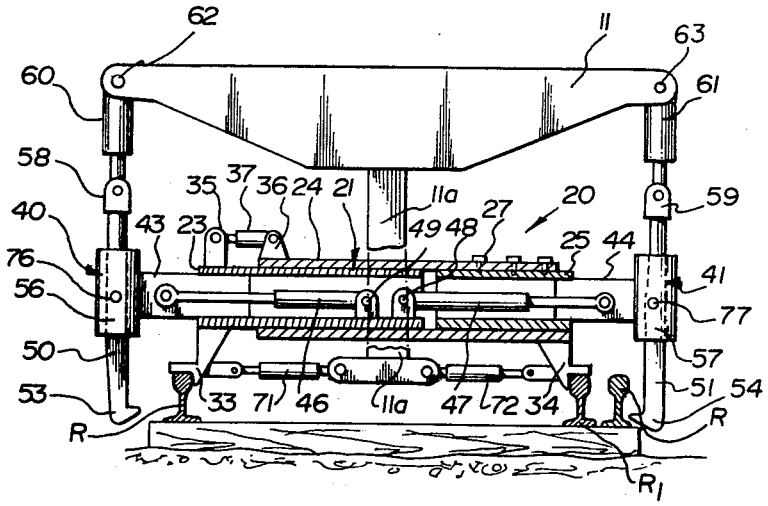
FIG. 2 is a detail, partly in section looking in the direction of the arrows II—II of FIG. 1.

The frame 11 is diagramatically shown in FIG. 2 to have a depending portion **11*a* to which is attached a pair of hydraulic piston and cylinder track aligning jacks 71, 72 connected between the main frame 11***a* and the sub frame 20 at the rail contacting elements 33, 34. It will of course be understood that the track aligning jack means 71, 72 could be a single double acting jack and could be connected between the sub frame 20 and the main frame 11 in any desirable condition provided that it can fulfill its function of aligning the track.

Locking devices 76, 77, in the form of removable pin connections are provided to lock the rail hooks 50, 51, to their rail guide means 40 and 41 so that the sub frame 20 may be locked to the track lifting jacks 60 and 61.

Swinging of the frame 20 longitudinally backwards and forwards, or the skewing of the frame relative to the track, may be provided for in conventional fashion by piston and cylinder arrangements 80 and conventional guide means not shown.

In operation the tamping machine 10 is positioned in an area where the track has to be corrected and the cylinders 60 and 61 are extended to lower the frame 20 down into rail engaging position whereafter the pins 76 and 77 are removed to release the sub frame 20 from the main frame 11. The cylinder 37 is now operated to adjust the gauge spacing between the rail contacting members 33 and 34 which are forced into abutting relationship with the inside of the rails R. The cylinder 37 is then locked. Cylinders 46 and 47 are extended to laterally position the hooks 53 and 54 which together with their guide ways are moved outwardly on the slides 43, 44 pivoting about the articulated connections 58, 59. The cylinders 60 and 61 are operated to position the rail hooks 53, 54 either under the outside of the ball of the rail R or under the base of the rail. In FIG. 2 a rail $R_1$ which is a rail forming part of a switch is shown, and it will be seen that the length of travel of the pistons 46, 47 is such as to accomodate any conventional spacing of rails in switches. Thus instead of engaging the right hand rail R the rail $R_1$ could be engaged, also a rail may be engaged at its ball and base. When the hooks 53 and 54 have been hooked in their desired position on the rails which they are to engage, the cylinders 46 and 47 are locked and the cylinders 60 and 61 operated to lift the track. At the same time the cylinder 71 or 72 is operated and since cylinder 37 is locked and cylinders 46 and 47 are locked, operation of the cylinder 71 or 72 will throw the entire sub frame 20 together with the hooks and rail engaging elements 33 and 34, and the track, sideways in an aligning direction relative to the main frame 11 of the machine 10.

It will be seen that the simplicity of the construction of the present lifting and aligning apparatus is such that it can operate in complex switch arrangements with a minimum of moving parts and since each rail is firmly gripped on both the inside and the outside, the force exerted by the track aligning jacks is distributed in a fairly even manner to both rails of the track.

What I claim as my invention is:

1. A railroad track lifting and aligning apparatus mounted for track travel on a longitudinally extending main frame, comprising a rail engaging sub frame extending transversely of the main frame and having two members connected for relative adjustment transversely of the main frame; a rail contacting element on each member for abutting the inside of a rail of the track; means to adjust and maintain the relative position of the members transversely of the main frame whereby to adjust the track gauge spacing between the rail contacting elements; a pair of substantially vertically extending rail hook guide means, one for each rail of the track, means for moving the guide means transversely of the main frame on the sub frame; rail hook means for each guide means for externally engaging each rail of the track; a track lifting jack for each rail connected on the one hand to said main frame and on the other to a rail hook means for adjusting the rail hook means into and out of the rail engaging position; and track aligning jack means operatively connected between said main frame and said sub frame.

2. Apparatus as claimed in claim 1 in which said members are connected together in telescoping relation and the rail contacting elements are provided externally, one on each member.

3. Apparatus as claimed in claim 2 in which the means to adjust and maintain the relative position of the telescoping members is a jack means connected at each end to one of the members and extending transversely of the main frame.

4. Apparatus as claimed in claim 2 in which the rail hook guide means for each rail are mounted on sliding guides each telescoped within a respective one of said telescoping members.

5. Apparatus as claimed in claim 4 in which the means for moving the rail hook guide means transversely of the main frame comprises a jack means for each guide means each connected on the one hand to one of the guide means and on the other hand to a common one of said telescoping members.

6. Apparatus as claimed in claim 1 in which each rail hook means comprises an inwardly directed hook end and an upwardly extending portion adapted to slide in said rail hook guide means and terminating in an articulated connecting means for connection to one of said track lifting jacks.

7. Apparatus as claimed in claim 6 in which each of the track lifting jacks is provided with a further articulated connecting means remote from its point of connection to its respective rail hook means.

8. Apparatus as claimed in claim 1 in which locking means is provided to lock said rail hook means to said rail hook guide means whereby to lock said sub frame to said track lifting jacks for lifting and lowering said sub frame out of and into track engagement position.

* * * * *